US011690456B2

(12) United States Patent
Wilson

(10) Patent No.: US 11,690,456 B2
(45) Date of Patent: Jul. 4, 2023

(54) FOLDING CHAIRS

(71) Applicant: Stannah Stairlifts Limited, Hampshire (GB)

(72) Inventor: Alexander Henry Gage Wilson, Hampshire (GB)

(73) Assignee: Stannah Stairlifts Limited, Hampshire (GB)

( * ) Notice: Subject to any disclaimer, the term of this patent is extended or adjusted under 35 U.S.C. 154(b) by 0 days.

(21) Appl. No.: 17/047,083

(22) PCT Filed: Apr. 11, 2019

(86) PCT No.: PCT/GB2019/051057
§ 371 (c)(1),
(2) Date: Oct. 13, 2020

(87) PCT Pub. No.: WO2019/197841
PCT Pub. Date: Oct. 17, 2019

(65) Prior Publication Data

US 2021/0153655 A1 May 27, 2021

(30) Foreign Application Priority Data

Apr. 12, 2018 (GB) ..... 1806032

(51) Int. Cl.

| | |
|---|---|
| ***A47C 1/121*** | (2006.01) |
| ***A47C 7/54*** | (2006.01) |
| ***A47C 7/56*** | (2006.01) |
| ***B66B 9/08*** | (2006.01) |

(52) U.S. Cl.
CPC ..... *A47C 1/121* (2013.01); *A47C 7/543* (2013.01); *A47C 7/56* (2013.01); *B66B 9/0853* (2013.01)

(58) Field of Classification Search
CPC ..... A47C 4/286; A47C 7/54; A47C 3/045; A47C 7/543; A47C 1/126; A47D 1/02
USPC ..... 297/35, 39, 40
See application file for complete search history.

(56) References Cited

U.S. PATENT DOCUMENTS 41,001 A * 12/1863 Hardy
1,668,213 A * 5/1928 Landine ..... B60N 2/305 297/14
2,888,099 A * 5/1959 Hoffmann ..... B66B 5/04 187/202

(Continued)

FOREIGN PATENT DOCUMENTS

DE 3800597 A1 7/1989
DE 29904529 U1 8/1999

(Continued)

OTHER PUBLICATIONS

International Search Report dated Jul. 15, 2019; International Application No. PCT/GB2019/051057.

(Continued)

*Primary Examiner* — Sarah B McPartlin
(74) *Attorney, Agent, or Firm* — Dinsmore & Shohl LLP

(57) ABSTRACT

A folding mechanism for a chair and, in particular, to a stairlift chair, has a seat base, backrest and armrests. The folding mechanism ensures that all parts of the chair remain in a swivel arc whether the chair is in an in-use configuration or folded configuration. Various additional features are described including armrests formed in part by flexible straps.

18 Claims, 5 Drawing Sheets

(56) References Cited

U.S. PATENT DOCUMENTS

| | | | | |
|---|---|---|---|---|
| 5,542,739 | A * | 8/1996 | Hultman | A47C 4/14 297/41 |
| 6,322,138 | B1 * | 11/2001 | Tang | A47C 4/286 297/16.2 |
| 6,343,805 | B1 * | 2/2002 | Roy | A61G 5/0891 297/411.31 |
| 7,703,854 | B2 * | 4/2010 | LaFreniere | A47C 7/543 297/31 |
| 10,264,887 | B2 * | 4/2019 | Rambaldo | A47C 4/08 |
| 10,278,506 | B2 * | 5/2019 | Yang | A47C 4/30 |
| 10,660,443 | B1 * | 5/2020 | Tsai | A47C 4/286 |
| 2006/0214476 | A1 * | 9/2006 | Rojas | A47C 7/383 297/3 |
| 2015/0359339 | A1 * | 12/2015 | Choi | A47C 4/286 297/42 |

FOREIGN PATENT DOCUMENTS

| | | | |
|---|---|---|---|
| EP | 1197465 | A1 | 4/2002 |
| EP | 1654960 | A1 | 5/2006 |
| GB | 2469093 | A | 10/2010 |
| WO | 2006051316 | A1 | 5/2006 |

OTHER PUBLICATIONS

United Kingdom Search Report dated Oct. 9, 2018; Application No. GB1806032.7.

* cited by examiner

FOLDING CHAIRS

CROSS-REFERENCE TO RELATED APPLICATIONS

This application is the U.S. national stage of PCT/GB2019/051057 filed Apr. 11, 2019, which claims priority of United Kingdom patent application 1806032.7 filed Apr. 12, 2018, both of which are hereby incorporated by reference in their entirety.

FIELD OF THE INVENTION

This invention relates to folding chairs and in particular, though not necessarily solely, to a folding stairlift chair.

BACKGROUND TO THE INVENTION

Chairs may be provided in forms that are capable of being folded for a number of reasons, one principal reason being to reduce the bulk of the chair when not in use. In the particular case of a stairlift chair, comprising a seat base, backrest and armrests, it is desirable that, when the seat base is folded into juxtaposition with the backrest and the armrests folded upwards, the depth dimension (hereafter referred to as the folded dimension and shown as 'D' in FIG. 2A) is as small as possible so that the stairlift causes the least possible interference with the use of the staircase by able-bodied persons. Another factor that influences the degree to which a stairlift intrudes into the staircase is the distance between the back of the backrest, and the adjacent wall. This distance should be as small as possible but needs to have regard to the fact that the distance between the chair and the wall will vary as the chair is swivelled. In a typical stairlift installation the distance between the outer edges of the armrests is the widest part of the installation and, when the armrests are displaced upwards into folded positions, the upper edges of the armrests often protrude outside the normal swivel arc when viewed in plan. Thus the chair must be moved further away from the wall and into the body of the staircase.

Similar problems may arise in other chair applications.

It is an object of the invention to provide a folding chair and/or aspects thereof which will go at least some way in addressing the aforementioned problems; or which will at least provide a novel and useful choice.

SUMMARY OF THE INVENTION

Accordingly, in a first aspect, the invention provides a folding chair having a seat base, a backrest and a pair of armrests, said seat base having a forward edge and a rear edge relative to said backrest and each of said armrests having a proximal end at or adjacent to said backrest, and a distal end, wherein said chair further includes a linkage connecting said seat base and said armrests, said linkage being configured to regulate displacement of said seat base between a substantially horizontal in-use position and a folded position in which said rear edge is raised relative to said backrest and said front edge is displaced in a folding direction toward said backrest while causing the distal ends of said armrests to be displaced in said folding direction toward said back rest.

Preferably said linkage is further configured to cause the distal ends of said armrests to be displaced toward one another as said seat base is displaced from said in-use position in said folding direction.

Preferably said folding chair includes a pair of uprights having upper ends and lower ends, the upper ends of said uprights comprising the distal ends of said armrests and the lower ends of said uprights being connected to said linkage about pivot axes.

Preferably said pivot axes, when viewed in plan are aligned at acute angles to the folding direction.

Preferably said pivot axes, when viewed in elevation, are aligned at acute angles to a horizontal plane.

Preferably said armrests are defined in part by flexible members.

Preferably said flexible members comprise and extend from said proximal ends.

Preferably said flexible members are substantially inelastic.

Preferably said flexible members are configured to limit movement of said armrests as said seat base is displaced from the folded position to the in-use position.

In a second aspect the invention provides a folding chair having a seat base displaceable between a substantially horizontal in-use position and a folded position; a backrest and a pair of armrests, said armrests having proximal ends at or adjacent to said backrest, and distal ends wherein said chair further includes a linkage connecting said seat base and said armrests, said linkage being configured to cause the distal ends of said armrests to be displaced toward one another as said seat base is displaced along a folding direction into said folded position.

Preferably said folding chair includes a pair of uprights having upper ends and lower ends, the upper ends of said uprights comprising the distal ends of said armrests and the lower ends of said uprights being connected to said linkage about pivot axes.

Preferably said pivot axes, when viewed in plan, are aligned at acute angles to the folding direction.

Preferably said pivot axes, when viewed in elevation, are aligned at acute angles to a horizontal plane.

Preferably said linkage is further configured to cause said armrests to be displaced in said folding direction toward said backrest as said seat base is displaced from said in-use position to said folded position.

Preferably said armrests are defined, in part, by flexible members.

Preferably said proximal ends are defined by ends of said flexible members.

In a third aspect the invention provides a stairlift chair comprising the folding chair as set forth above.

In a fourth aspect the invention provides a stairlift including the stairlift chair as set forth above.

Many variations in the way the present invention can be performed will present themselves to those skilled in the art. The description which follows is intended as an illustration only of one means of performing the invention and the lack of description of variants or equivalents should not be regarded as limiting. Subject to the scope of the appended claims, wherever possible, a description of a specific element should be deemed to include any and all equivalents thereof whether in existence now or in the future.

BRIEF DESCRIPTION OF THE DRAWINGS

The various aspects of the invention will now be described with reference to the example shown in the accompanying drawings in which.

DETAILED DESCRIPTION OF WORKING EMBODIMENT

Figure 1A:
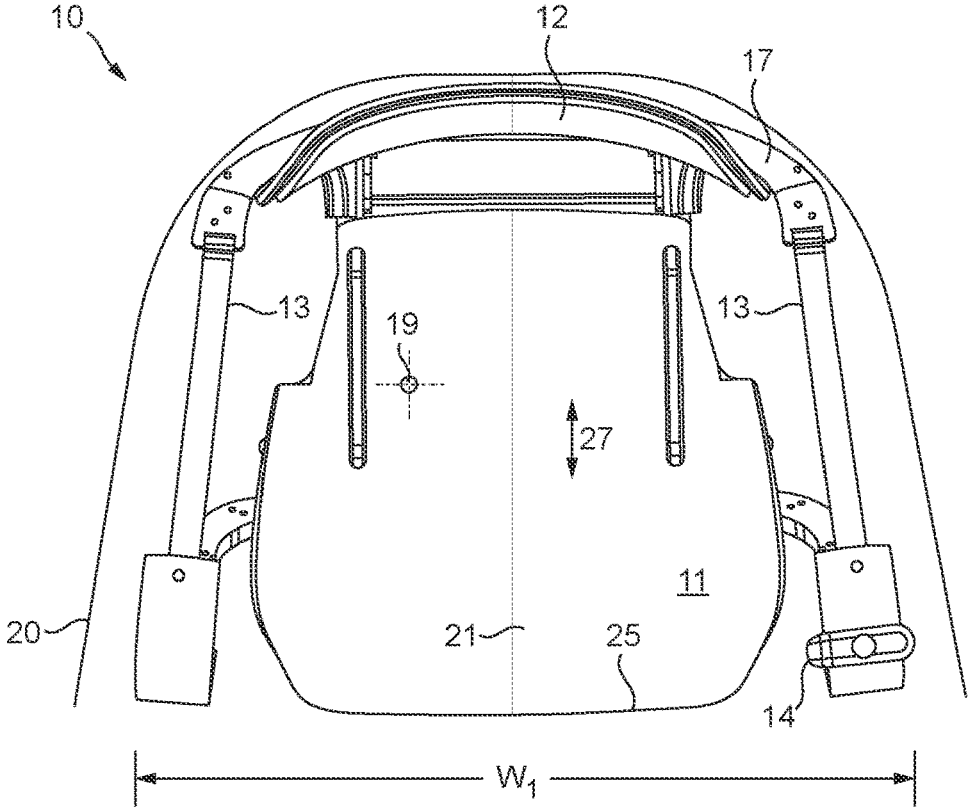
FIGS. 1A & 1B are plan and elevational views of a folding chair according to the invention in an in-use configuration.

This invention relates to folding chairs but has been developed particularly for application to a stairlift chair. Accordingly the embodiments described herein will be directed to a stairlift chair but it should be appreciated that other applications of folding chairs may fall within the scope of the invention.

A chair 10 according to the invention includes a seat base 11, a backrest 12 and a pair of armrests 13. Mounted on one of the armrests 13 is a hand control 14 to allow a user to control the operation of the stairlift of which the chair forms part.

The seat base 11 is fixed to a chair chassis 15 (FIG. 4) by means of a linkage 16 that will be described in greater detail below. The chair chassis 15 also includes a backrest support 17 and a swivel connection 18 whereby the chair can be mounted to a stairlift carriage (not shown). The swivel connection 18 defines a swivel axis 19 (FIG. 1A) around which the chair can swivel to allow a user to easily enter and exit the chair. The swivel axis 19, in turn, establishes a swivel arc 20 within which all parts of the chair 10 should remain, whether the chair is in the in-use configuration shown in FIGS. 1A & 1B, in the fully folded configuration shown in FIGS. 2A & 2B, or in any configuration therebetween.

Figure 1B:
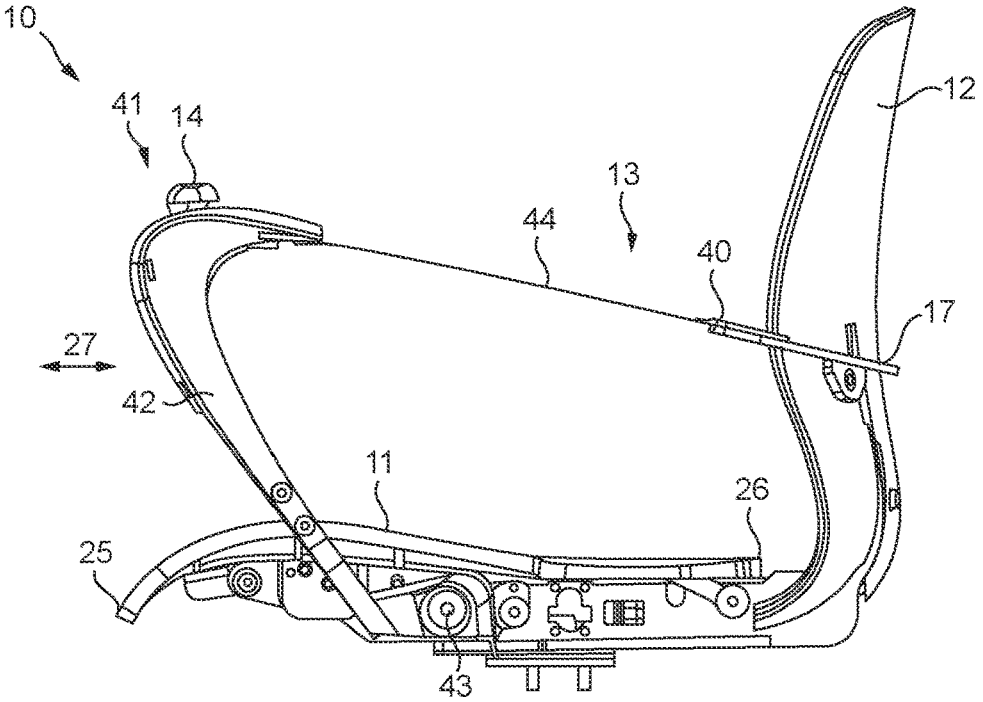
Figure 2A:
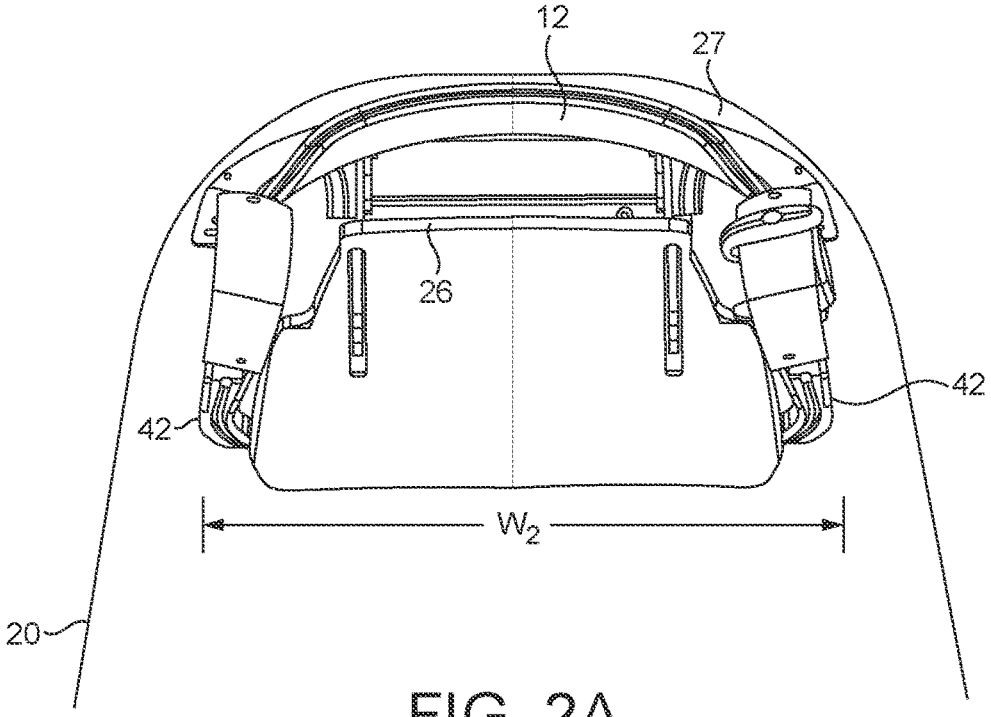
FIGS. 2A & 2B are plan and elevational views of the folding chair of FIG. 1 in a folded configuration.
Figure 2B:
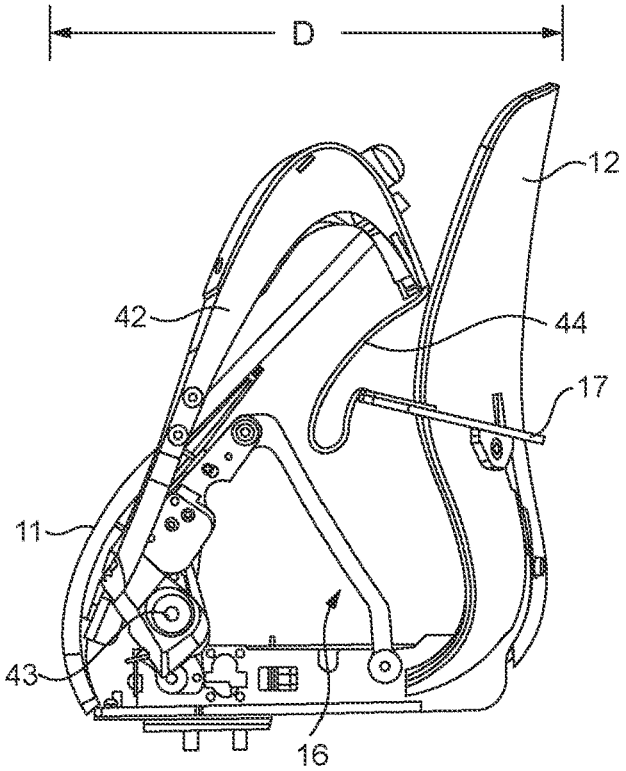

It will be noted from FIG. 1A that the swivel axis 19 is offset from the centreline 21 of the chair and this particular offset may not be appropriate for all stairlift installations. The swivel connection 18 may therefore be mounted on the opposite side of the chair chassis if a particular installation requires the offset to be on the opposite side.

Figure 3A:
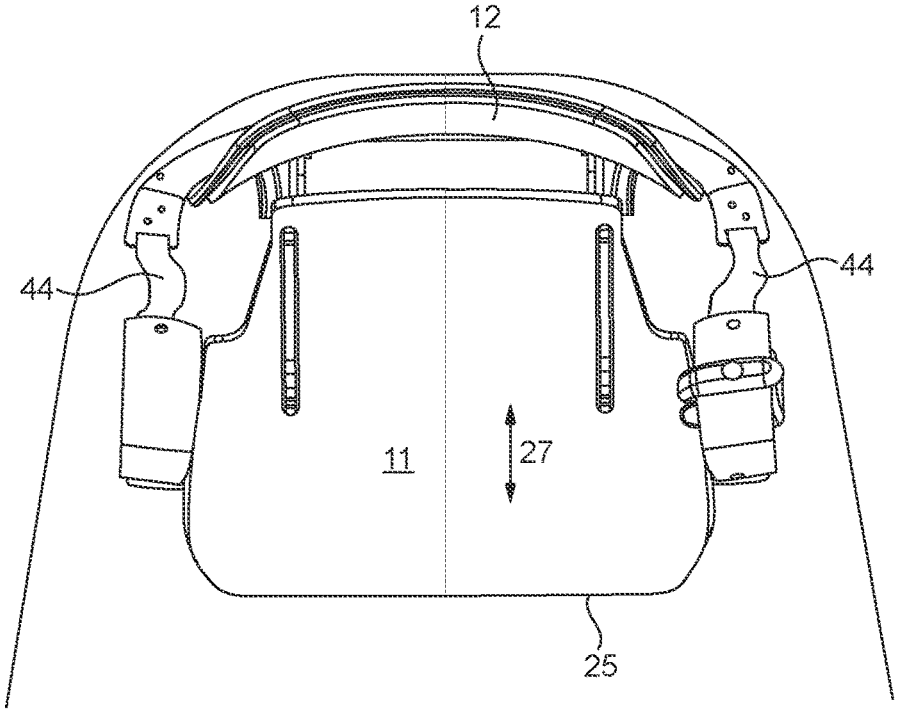
FIGS. 3A & 3B are plan and elevational views of the folding chair of FIGS. 1 & 2 in a part-folded configuration.
Figure 3B:
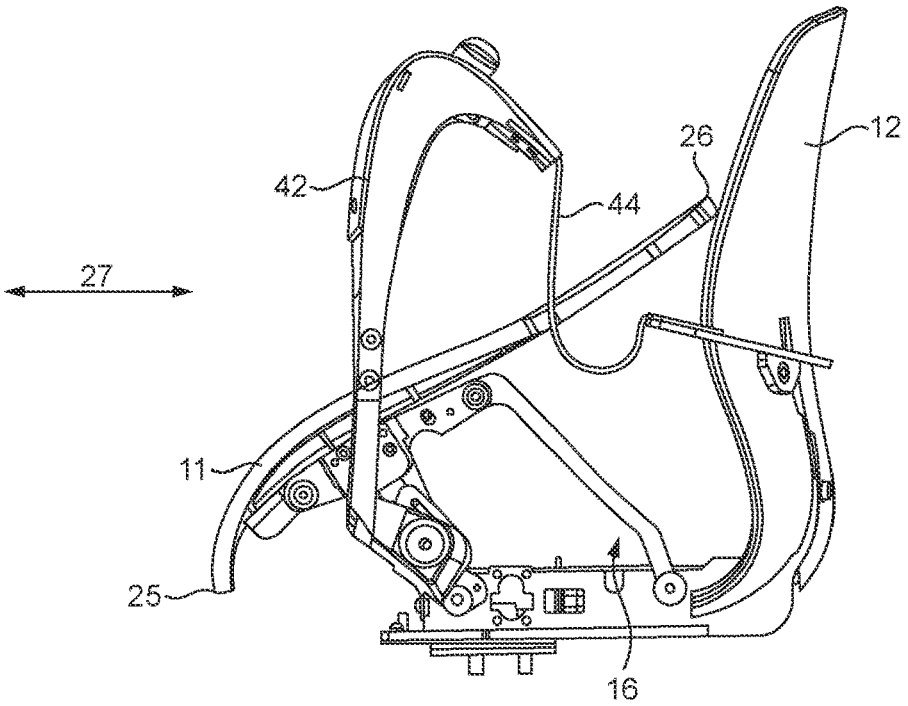

The seat base 11 has a forward edge 25 and a rear edge 26 relative to the backrest 12 and, as can be seen by comparing FIGS. 1, 2 & 3, when the chair is folded from the in-use configuration to the folded configuration, the linkage 16 is configured to cause the rear edge 26 of the initially substantially horizontal seat base to rise relative to the backrest 12 while the forward edge 25 is displaced rearwards in a folding direction indicated by arrow 27. It will be appreciated that the folding direction is substantially along and parallel to the longitudinal centreline 21 of the chair.

The linkage 16 essentially comprises two identical four-bar linkages 30*a* and 30*b* mounted on opposite sides of the chair chassis 15 and interconnected by crossbars 31 to add rigidity. The base of each of the linkages 30*a*, 30*b* is provided by the chassis 15, the remaining parts comprising front links 32*a*, 32*b*, rear links 33*a*, 33*b* and top links 34*a*, 34*b* which are pivotally attached to the upper ends of the front and rear links. The top links preferably include plates 35 to which the underside of seat base 11 may be fixed. The geometry of the individual links will be readily understandable to those skilled in the art and ensure that the seat base 11 moves from the substantially horizontal position shown in FIGS. 1A, 1B to the folded position shown in FIGS. 2A, 2B in which the front edge 25 is as far back as the linkage 16 will allow and the rear edge 26 is raised as high as the linkage 16 will allow.

An important feature of one aspect of the invention is that the armrests are also connected to linkage 16 and are folded as the seat base 11 is displaced into the folded position; and unfolded as the seat base is returned to the in-use position. A further important feature is that, as the seat base is moved from the in-use position toward the folded position, the distal ends of the armrests are preferably displaced inwardly towards one another.

The folding mechanism will now be described with reference to one side of the chair, it being appreciated that each side is the mirror image of the other.

Each armrest 13 has a proximal end 40 at or adjacent to the backrest 12 and a distal end 41. In the form shown the distal end 41 is defined by the upper end of an upright 42, the lower end of which is pivotally connected to a front link 32 of linkage 30, at 43. The section of the armrest extending between the upright 42 and the proximal end 40 is preferably provided by a flexible member 44 that is held taut when the chair is in the in-use position but can freely change shape during folding. Whilst being flexible the member 44 is preferably inelastic so that it can contribute to the unfolding function when the chair is again returned to an in-use configuration. Armrest member 44 is preferably formed from a webbing material and may be fixed to the free end of backrest support 17.

Figure 5A:
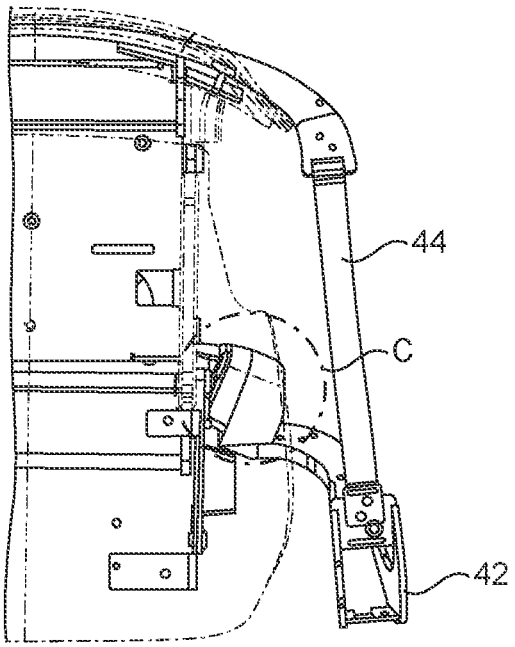
FIG. 5A is a plan view. in smaller scale, of one-half of parts of a folding chair according to the invention.
Figure 5B:
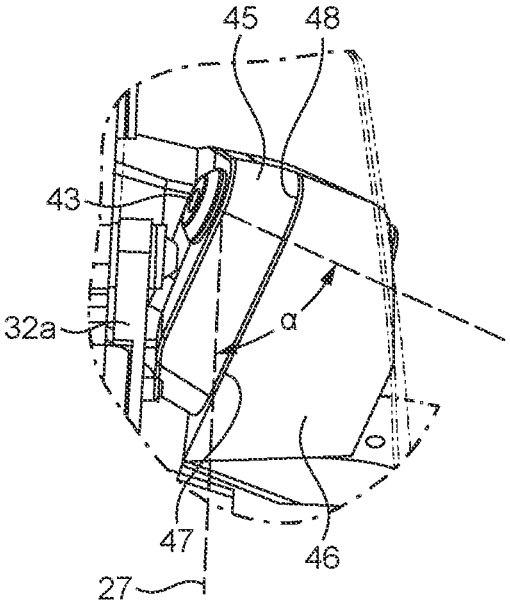
FIG. 5B is an enlarged view of the features circled 'C' in FIG. 5A.
Figure 6A:
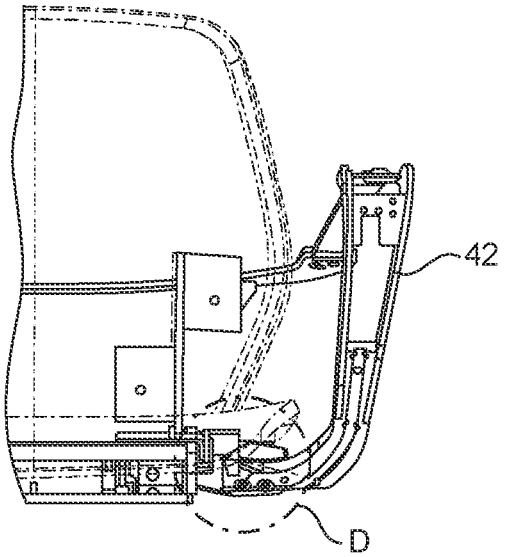
FIG. 6A is a front elevational view of that which is shown in FIG. 5A.
Figure 6B:
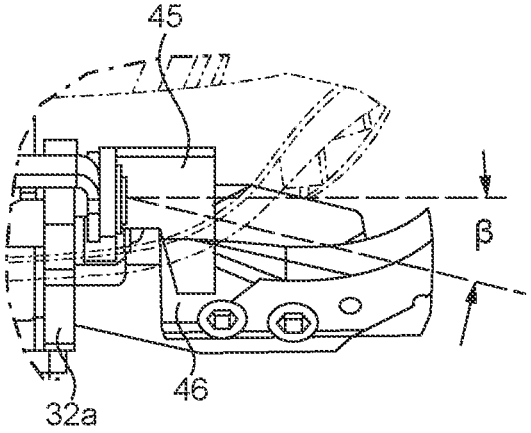
FIG. 6B is an enlarged view of the features circled 'D' in FIG. 6A.

Referring to FIGS. 5A, 5B, 6A & 6B, the pivot 43 at the bottom of upright 42 is preferably incorporated in a knuckle joint comprising base block 45 fixed to the front link 32 and arm block 46 fixed to or formed in the bottom end of upright 42, the two blocks having mating planar surfaces 47 and 48 respectively so that the block 46 can slide over block 45 and around the pin that defines the pivot 43. When viewed in plan as shown in FIGS. 5A & 5B, the angle between the axis defined by pivot 43, and the folding direction 27, is acute angle $\alpha$. Angle $\alpha$ is typically in the order of 70°. When viewed in front elevation as shown in FIGS. 6A & 6B, the pivot axis is aligned at angle $\beta$ to a horizontal plane. Angle $\beta$ is typically in the order of 12.5°.

The alignment of the knuckle surfaces 47 & 48 has the effect that, as movement is initiated to displace the seat base 11 from the in-use configuration to the folded configuration, arm block 46 remains in position while base block 45 rises causing the distal end 41 to be displaced inwardly. In most cases the mass of the upright 42, supported by the taut flexible armrest member 44, is sufficient to maintain the upright in place as the knuckle functions and the base block 45 rises but, should this not be sufficient, some form of bias such as a torsion spring located about pivot pin 43 may be provided to maintain the arm block, and thus the upright 42, in the 'down' position.

Suitable mechanical stops (not shown) are provided to limit the degree to which the base block 45 may rise relative to the arm block 46 about pivot 43. When the mechanical stops engage, the distance between the distal ends of the armrests will have lessened from width $W_1$ shown in FIG. 1A to width $W_2$ shown in FIG. 2A due to the inward displacement induced by angled pivot 43. This width reduction is achieved before the chair is fully folded; once the mechanical stops have engaged then the upright 42 is effectively locked to the linkage 30 and is rotated with the linkage in an clockwise manner to the folded configuration shown in FIGS. 2A & 2B.

To reverse the folding process and change the chair from the folded configuration to the in-use configuration, the seat base 11 is displaced downwardly causing the front edge 25 to be displaced forward and the armrest upright 42 to be rotated in an anti-clockwise direction. This rotation, in turn, causes the flexible armrest member 44 to become taut once again, preventing further rotation of the upright 42. At this point, further displacement of the seat base causes the mechanical stops between knuckle blocks 45 and 46 to disengage whereupon block 45 is displaced downwardly relative to block 46 about angled pivot 43 and causing the distal ends of the armrests to be displaced apart as the seat base again assumes the in-use position.

Figure 4:
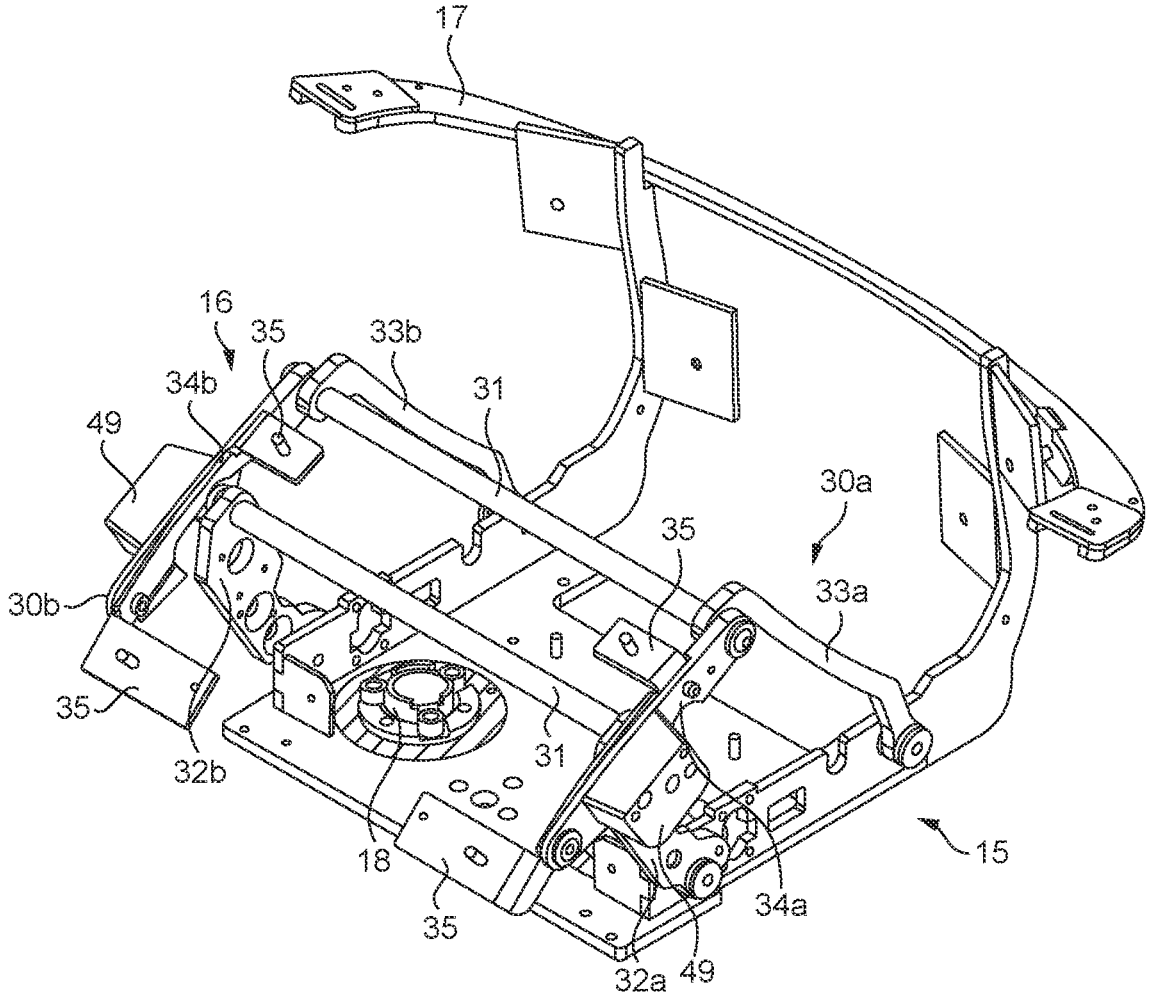
FIG. 4 is an isometric view of a chair chassis and linkage incorporated in the folding chair shown in FIGS. 1 to 3.

A feature of the embodiment described above is that the folding process must be applied through the seat base rather than the armrests. To deter users from applying a folding force to the armrests, stop blocks 49 shown in FIG. 4 are preferably added to the top links 34*a*, 34*b* to prevent rotation of the uprights 42 in a clockwise direction.

It will thus be appreciated that the invention, at least in the case of the embodiment described, has the advantage that the seat base and armrests can be folded in close juxtaposition to the backrest, keeping the folded dimension to a minimum while ensuring that the armrests do not protrude outside the swivel arc, whether in-use or folded.

The invention claimed is:

1. A folding chair comprising:

a seat base having a forward edge, a rear edge and a pair of spaced side edges extending between said forward edge and said rear edge;

a backrest; and a pair of armrests pivotally joined to the side edges of said seat base, each armrest having a proximal end at or adjacent to said backrest, and a distal end, said chair further including a linkage connecting said seat base and said armrests, said linkage being configured to regulate displacement of said seat base between a substantially horizontal in-use position and a folded position in which said rear edge is raised relative to said backrest such that the rear edge extends above the proximal end of the pair of armrests, and said front edge is displaced in a folding direction toward said backrest while causing the distal ends of said armrests to be displaced in said folding direction toward said back rest.

2. A folding chair as claimed in claim 1, wherein said linkage is further configured to cause the distal ends of said armrests to be displaced toward one another as said seat base is displaced from said in-use position in said folding direction.

3. A folding chair as claimed in claim 1, further comprising a pair of uprights having upper ends and lower ends, the upper ends of said uprights comprising the distal ends of said armrests and the lower ends of said uprights being connected to said linkage about pivot axes.

4. A folding chair as claimed in claim 3, wherein said pivot axes, when viewed in plan are aligned at acute angles to the folding direction.

5. A folding chair as claimed in claim 4, wherein said pivot axes, when viewed in elevation, are aligned at acute angles to a horizontal plane.

6. A folding chair as claimed in claim 1, wherein said armrests are defined in part by flexible members.

7. A folding chair as claimed in claim 6, wherein said flexible members comprise and extend from said proximal ends.

8. A folding chair as claimed in claim 7, wherein said flexible members are substantially inelastic.

9. A folding chair as claimed in claim 8, wherein said flexible members are configured to limit movement of said armrests as said seat base is displaced from the folded position to the in-use position.

10. A folding chair comprising:

a seat base having a forward edge, a rear edge and a pair of spaced side edges extending between said forward edge and said rear edge said seat base being displaceable between a substantially horizontal in-use position and a folded position;

a backrest; and a pair of armrests, pivotally joined to the side edges of said seat base, said armrests having proximal ends, at or adjacent to said backrest, and distal ends;

said chair further comprising a linkage connecting said seat base and said armrests, said linkage being configured to cause the distal ends of said armrests to be displaced toward one another as said seat base is displaced along a folding direction into said folded position, such that the rear edge of said seat base extends above the proximal end of the pair of armrests.

11. A folding chair as claimed in claim 10, further comprising a pair of uprights having upper ends and lower ends, the upper ends of said uprights comprising the distal ends of said armrests and the lower ends of said uprights being connected to said linkage about pivot axes.

12. A folding chair as claimed in claim 11, wherein said pivot axes, when viewed in plan, are aligned at acute angles to the folding direction.

13. A folding chair as claimed in claim 12, wherein said pivot axes, when viewed in elevation, are aligned at acute angles to a horizontal plane.

14. A folding chair as claimed in claim 10, wherein said linkage is further configured to cause said armrests to be displaced in said folding direction toward said backrest as said seat base is displaced from said in-use position to said folded position.

15. A folding chair as claimed in claim 10, wherein said armrests are defined, in part, by flexible members.

16. A folding chair as claimed in claim 15, wherein said proximal ends are defined by ends of said flexible members.

17. A stairlift chair comprising a folding chair as claimed in claim 1.

18. A stairlift including the stairlift chair as claimed in claim 17.

* * * * *